US007817928B2

(12) United States Patent
Tsuchida et al.

(10) Patent No.: US 7,817,928 B2
(45) Date of Patent: Oct. 19, 2010

(54) IMAGE FORMING APPARATUS AND IMAGE FORMING METHOD

(75) Inventors: Yoshie Tsuchida, Osaka (JP); Takafumi Miyazaki, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 276 days.

(21) Appl. No.: 12/071,338

(22) Filed: Feb. 20, 2008

(65) Prior Publication Data

US 2008/0226313 A1 Sep. 18, 2008

(30) Foreign Application Priority Data

Mar. 12, 2007 (JP) ..... 2007-061818

(51) Int. Cl.
*G03G 15/01* (2006.01)
*G03G 15/14* (2006.01)

(52) U.S. Cl. ..... 399/44; 399/299; 399/302

(58) Field of Classification Search ..... 399/44, 399/299, 301, 302, 308
See application file for complete search history.

(56) References Cited

U.S. PATENT DOCUMENTS 6,181,892 B1 * 1/2001 Fujimori ..... 399/72
6,477,340 B2 * 11/2002 Tomizawa et al. ..... 399/66
6,731,899 B2 * 5/2004 Takahata et al. ..... 399/302

FOREIGN PATENT DOCUMENTS

| | | | |
|---|---|---|---|
| JP | 11-143172 | | 5/1999 |
| JP | 2001-183913 | | 7/2001 |
| JP | 2001-188424 | | 7/2001 |
| JP | 2004-272206 | | 9/2004 |
| JP | 2005-173114 | | 6/2005 |
| JP | 2005-173630 | | 6/2005 |
| JP | 2006078510 | A * | 3/2006 |
| JP | 2006084792 | A * | 3/2006 |
| JP | 2006163267 | A * | 6/2006 |

* cited by examiner

*Primary Examiner*—David M Gray
*Assistant Examiner*—Fred Braun
(74) *Attorney, Agent, or Firm*—Harness, Dickey & Pierce, P.L.C.

(57) ABSTRACT

An image forming apparatus includes an image carrier, an intermediate transferring body and a contact type secondary transferring member transferring an image from the intermediate transferring body to a recording medium. The apparatus forms an image with respective developers for multiple colors and uses a predefined adjustment pattern to make density adjustment and position adjustment of respective color images. After execution of the density adjustment and/or the position adjustment, a stain prevention pattern is formed with a yellow developer to cover an area where the adjustment pattern is attached to the secondary transferring member.

10 Claims, 7 Drawing Sheets

IMAGE FORMING APPARATUS AND IMAGE FORMING METHOD

BACKGROUND OF THE INVENTION

1. Field of the Invention

The present invention relates to an electrophotographic image forming apparatus and an image forming method thereof, and particularly relates to some techniques for preventing the back surface and edges of sheets from being stained in the secondary transferring unit.

2. Description of the Related Art

Currently, the most prevalent type of color image forming apparatus employs an intermediate transferring body. Individual color images formed on respective image carriers are sequentially superimposed and transferred onto the intermediate transferring body (belt), and then the superimposed and transferred images are transferred together onto a sheet. In such an image forming apparatus, a secondary transferring member (roller) in contact with the back surface of a sheet is often used to transfer multiple color toner images onto the sheet together.

Also in cases of color printers or color copiers, the density and misalignment of the respective colors with respect to the sub-scanning direction are periodically adjusted in a certain timing. Although there are a variety of specific methods for implementing the adjustment, according to one adjustment method as shown in FIG. 7, upon detection of a predefined action such as switching of the power supply, opening and closing of an outer cover or completion of a jam operation, the adjustment of the density and misalignment of respective colors with respect to the sub-scanning direction is activated.

In this adjustment process, a predefined adjustment pattern (reference pattern) is formed and carried onto an intermediate transferring body. Some sensors disposed along the belt to face the intermediate transferring body are used to detect the density of respective color patterns and/or the misalignment among respective color photoconductors. The developing bias and/or others are adjusted to some proper values and/or the color misalignment is corrected by tuning (adjusting) the printing timing onto the photoconductors.

In arrangements without any contact and release mechanism for making and releasing contact between the secondary transferring member and the intermediate transferring body, toner composing a density adjustment pattern and/or a position adjustment pattern becomes attached to the secondary transferring member, and consequently the back surface and/or the image surface of a sheet may be stained in secondary transferring operations at the image formation and/or both sided recording operations, respectively.

In order to address the problem, Japan Laid-Open Patent Application No. 2004-272206 discloses an image forming apparatus for collecting toner from the secondary transferring member to the intermediate transferring body efficiently by applying positive and negative bias voltages to the secondary transferring roller alternately.

According to the image forming apparatus as disclosed in this document, the toner is moved toward the intermediate transferring belt through operations of an electric field applied to the transferring roller. However, it is impossible to deliver the toner to the intermediate transferring body completely even through intensive operations of the electric field. Since only electrically-charged toner is electrostatically movable, weakly charged toner and non-charged toner cannot be electrostatically moved. When the weakly charged toner and/or the non-charged toner is attached to the secondary transferring member, it is hard to move the toner to the intermediate transferring body even through electrostatic application of an electric field, and thus the back surface of a sheet may be stained during passage. In addition, Japan Laid-Open Patent Application No. 2004-272206 does not take environmental variations into consideration, and thus if the environment varies, the optimum cleaning bias is not applied to the secondary transferring member, resulting in reduced efficiency of the toner collection.

SUMMARY OF THE INVENTION

The present invention addresses the above-mentioned conventional problems. It is an object of the present invention to provide an image forming apparatus and an image forming method that can prevent paper sheets from being stained due to adjustment patterns easily and inexpensively.

According to one feature of the present invention, there is provided an image forming apparatus including an image carrier, an intermediate transferring body and a contact type secondary transferring member transferring an image from the intermediate transferring body to a recording medium but including no contact and release mechanism contacting and/or releasing the secondary transferring member with/from the intermediate transferring body, the image forming apparatus forming an image with respective developers for multiple colors and using a predefined adjustment pattern to make density adjustment and position adjustment of respective color images, after execution of the density adjustment and/or the position adjustment, a stain prevention pattern being formed with a yellow developer to cover an area where the adjustment pattern is attached to the secondary transferring member, the formed stain prevention pattern being carried on the intermediate transferring body.

In one embodiment of the present invention, a main scanning directional size of an adjustment pattern for the position adjustment may be smaller than a main scanning directional size of an adjustment pattern for the density adjustment, and a main scanning directional position of an adjustment pattern for the position adjustment may be within a main scanning directional width of an adjustment pattern for the density adjustment.

In one embodiment of the present invention, a density of the stain prevention pattern may be made equal to a density of an adjustment pattern for the density adjustment.

According to another feature of the present invention, there is provided an image forming apparatus including an image carrier, an intermediate body and a contact type secondary transferring member transferring an image from the intermediate transferring body to a recording medium but including no contact and release mechanism contacting and/or releasing the secondary transferring member with/from the intermediate transferring body, the image forming apparatus forming an image with respective developers for multiple colors and using a predefined adjustment pattern to make density adjustment and position adjustment of respective color images, a main scanning directional size of an adjustment pattern for the position adjustment being smaller than a main scanning directional size of an adjustment pattern for the density adjustment, a main scanning directional position of an adjustment pattern for the position adjustment being within a main scanning directional width of an adjustment pattern for the density adjustment, in the density adjustment and the position adjustment, the position adjustment being first made and subsequently the density adjustment being made, and a final color adjustment pattern of respective color adjustment patterns for the density adjustment being a yellow adjustment pattern, the yellow adjustment pattern being provided to cover an area where the color adjustment patterns other than the yellow adjustment pattern are attached to the secondary transferring member.

In one embodiment of the present invention, in the density adjustment and/or the position adjustment, a bias with the same polarity as electrifying polarity of the developer may be applied to the secondary transferring member.

In one embodiment of the present invention, the bias may be controlled depending on environmental conditions.

In one embodiment of the present invention, the adjustment pattern for the density adjustment may be configured as an area pattern.

In one embodiment of the present invention, the adjustment pattern for the position adjustment may be configured as a linear pattern.

In one embodiment of the present invention, the secondary transferring member may comprise a transferring roller, and a sub-scanning directional size of the stain prevention pattern or a size of a yellow adjustment pattern of the density adjustment may be larger than a circumferential length of the transferring roller.

According to another feature of the present invention, there is provided a method of forming an image, an image transferred from an image carrier to an intermediate transferring body being transferred by a contact type secondary transferring member from the intermediate transferring body to a recording medium, and after a predefined pattern is used to make image density adjustment and/or image position adjustment for multiple colors, a stain prevention pattern being formed of a yellow developer to cover an area where the adjustment pattern is attached to the secondary transferring member.

According to the embodiments of the present invention, even if the density adjustment pattern or the position adjustment pattern becomes attached to the secondary transferring member, the stain prevention pattern consisting of yellow toner is further attached on the density adjustment pattern or the position adjustment pattern as attached. Since the yellow toner stain prevention pattern is unnoticeable or rarely recognized for white sheets, it is possible to prevent the sheets from being stained. In addition, the present invention is advantageous to prevention of the edge of sheet from being stained, resulting in the high quality of the sheet being maintained.

Other objects, features and advantages of the present invention will become more apparent from the following detailed description when read in conjunction with the accompanying drawings.

DETAILED DESCRIPTION OF THE PREFERRED EMBODIMENTS

Embodiments of the present invention will be described below with reference to the accompanying drawings.

Figure 1:
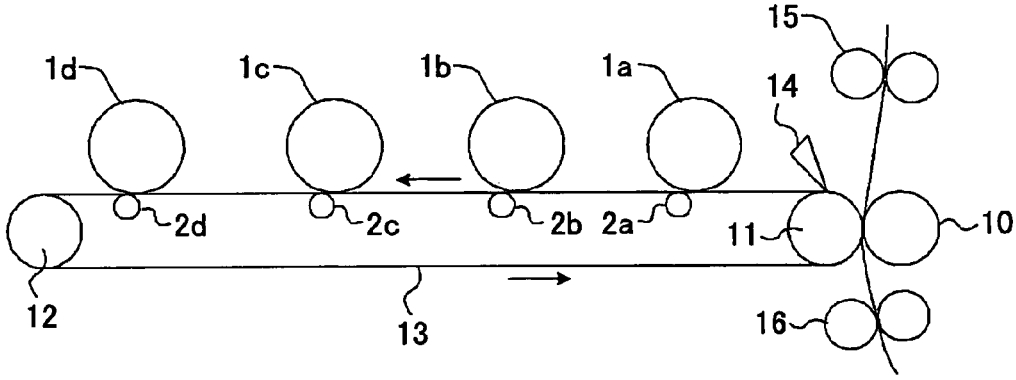
FIG. 1 is a schematic view of core components of an image forming apparatus according to one embodiment of the present invention.

FIG. 1 is a schematic view of core components of an image forming apparatus according to one embodiment of the present invention. In this embodiment, the image forming apparatus is a color image forming apparatus capable of forming full color images in a tandem fashion. In the image forming apparatus, four imaging units having respective photoconductive drums 1*a*-1*d* serving as image carriers are provided along the top surface of an intermediate transferring belt serving as an intermediate transferring body. Although omitted in the illustration for clarity, in each of the imaging units, an electrifying unit, a developing unit, a cleaning unit and others are disposed around the respective photoconductive drums 1*a*-1*d*. Furthermore, transferring rollers 2*a*-2*d* are provided as primary transferring units within the intermediate transferring belt 13 to face the respective photoconductive drums 1*a*-1*d*.

Although not illustrated, optical writing units are provided above the four imaging units. In cases of laser scanning based optical writing units, a polygon mirror and/or other types of mirrors may be used to direct modulated laser light toward the surface of the photoconductive drums 1*a*-1*d* of the respective color imaging units.

The intermediate transferring belt 13 is strained between two supporting rollers 11 and 12. The supporting roller 11 serves as a driving roller, a secondary transferring facing roller and a roller facing a cleaning blade 14 together. The supporting roller 12 serves as a tension roller. The intermediate transferring belt 13 is rotationally driven in the counterclockwise direction as illustrated. The intermediate transferring belt 13 is made of some polymer materials such as TPE (Thermoplastic Elastomer alloy), PC (Polycarbonate), PI (Polyimide), PAA (Polyamide Alloy) and PVDF (Polyvinylidene-Fluoride). Although not illustrated, some sensors such as reflective type photo sensors may be provided for detection of adjustment patterns as described below to face the belt surface of the intermediate transferring belt 13.

Also, a secondary transferring roller 10 is disposed to face the supporting roller 11 serving as the secondary transferring facing roller. The secondary transferring roller 10 is urged toward the supporting roller 11 with a force in such a manner that the secondary transferring roller 10 and the supporting roller 11 sandwich the intermediate transferring belt 13. The secondary transferring roller 10 has no contact and release mechanism with/from the intermediate transferring belt 13 and is always in contact with the intermediate transferring belt 13. Strictly speaking, since sheets pass therebetween or some toner layer exists therebetween, the secondary transferring roller 10 is not always in contact with the intermediate transferring belt 13 completely.

Resist rollers 16 are disposed at the upstream side of the secondary transferring unit (at the upstream side of the sheet conveying direction) where the secondary transferring roller 10 faces the secondary transferring facing roller 11. On the other hand, a fixing unit 15 is provided at the downstream side of the secondary transferring unit. In this illustration, the fixing unit 15 includes a fixing roller and a pressure roller.

Alternatively, a belt fixing unit may be adopted as the fixing unit 15. Also, the heating scheme is not limited to particular heater schemes and an induction heating scheme may be adopted.

Furthermore, although not illustrated, a sheet feeding unit is provided below the intermediate transferring belt 13 to feed each sheet from a sheet storage unit such as a tray or a cassette. In addition, although not described in detail, other well-known components required for color image forming apparatuses may be provided such as electric components, control components, operation panels and sheet output units. Furthermore, some additional components such as a scanner, ADF (Automatic Document Feeder) and/or a both-sided printing unit may be provided as needed.

Next, an exemplary image forming operation of the above configured color image forming apparatus will be described.

In operation, the photoconductive drums 1*a*-1*d* of the respective imaging units are rotationally driven by a driving unit (not shown) in the clockwise direction, and the surfaces of the photoconductive drums 1*a*-1*d* are uniformly electrified to a predefined polarity by an electrifying unit. Scanning light traveling from an optical writing unit is illuminated onto the electrified surfaces of the photoconductive drums 1*a*-1*d*, resulting in electrostatic latent images being formed on the electrified surfaces of the photoconductive drums 1*a*-1*d*. Then, image information exposed on the respective photoconductive drums 1*a*-1*d* consists of respective single-color image information decomposed from a desired full color image for each color of yellow, magenta, cyan and black. Respective color toners are applied by the developing unit to the formed electrostatic latent image to make visible the respective color toner images.

Also, the intermediate transferring belt 13 is rotationally driven in the counterclockwise direction as illustrated, and the primary transferring rollers 2*a*-2*d* of the respective imaging units are used to superpose and transfer the respective color toner images from the photoconductive drums 1*a*-1*d* to the intermediate transferring belt 13 sequentially. In this fashion, the resultant full-color toner image can be carried on the surface of the intermediate transferring belt 13.

Alternatively, any one of the imaging units can be used to form a single color image. Alternatively, some of the imaging units can be used to form two- or three-color images. In monochrome printing, the black imaging unit of the four imaging units is used for image formation.

After execution of the transferring of the respective color toner images, residual toners attached on the surfaces of the photoconductive drums 1*a*-1*d* are removed by the cleaning units, and then the electric potentials of the surfaces are initialized by de-electrifying units for subsequent image formation.

On the other hand, a sheet is supplied by the sheet feeding unit. The resist rollers 16 deliver the sheet to the secondary transferring unit in synchronization with the full-color toner image carried on the intermediate transferring belt 13. In this embodiment, a transferring voltage with the polarity opposite to the toner electrifying polarity of the toner image on the intermediate transferring belt 13 is applied to the secondary transferring roller 10, resulting in the toner image on the intermediate transferring belt 13 being transferred onto the delivered sheet. When the toner image transferred sheet passes through the fixing unit 15, the toner image is fused and fixed to the sheet with heat and pressure. The fixed sheet is supplied and stacked in an output tray (not shown).

After execution of the secondary transferring, residual toner on the intermediate transferring belt 13 is collected in a cleaner unit (not shown) by means of the cleaner blade 14.

Preferably, the secondary transferring roller 10 may be made of elastic material. For example, an ionic conductive roller (urethane+carbon distribution, NBR, hydrin) or an electronic conductive roller (EPD) may be advantageous as the secondary transferring roller 10.

In this embodiment, the intermediate transferring body 13 is configured in such a manner that the belt is strained between two supporting members and that the secondary transferring facing roller 11 can have various functions. However, the present invention is not limited to this configuration and can be applied to any transferring system having the secondary transferring unit.

Figure 2:
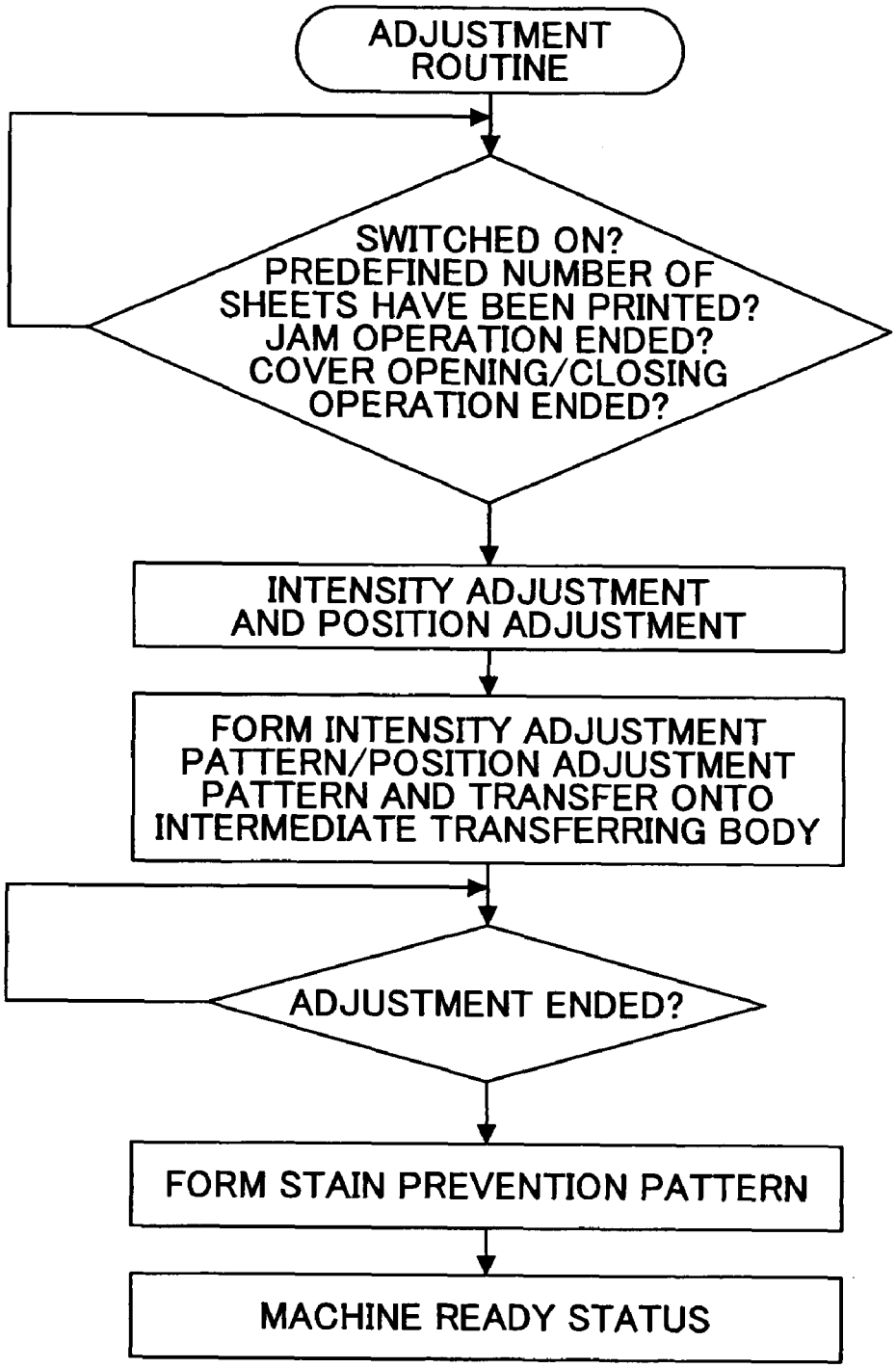
FIG. 2 is a flowchart of exemplary operations including image density adjustment, image misalignment adjustment and subsequent stain prevention pattern formation for use in the image forming apparatus.

In the color image forming apparatus, as illustrated in FIG. 2, upon detection of a predefined event such as power switching of the apparatus, opening and closing of an external cover or termination of jam operations, the density adjustment and the sub-directional misalignment adjustment of the respective colors are made by using a predefined density adjustment pattern and a predefined position adjustment pattern. These adjustments are similar to some conventional ones. Note that the density adjustment and the position adjustment may be made separately or integrally. Also, the adjustments do not need to be made in a fixed sequence. In FIG. 2, the density adjustment and the position adjustment are made at the same time or integrally.

In this color image forming apparatus, after execution of the density adjustment and/or the position adjustment, yellow toner is used to form a predefined pattern (referred to as a stain prevention pattern hereinafter) and is transferred from the intermediate transferring belt 13 to the surface of the secondary transferring roller 10. As a result, even if toner of the density adjustment pattern or the position adjustment pattern as described above becomes attached to the secondary transferring roller 10, the stain prevention pattern for the yellow toner is further attached on the attached toner, resulting in the yellow toner being presented on top of the surface of the secondary transferring roller 10. Even if the yellow toner is attached to the back surface (in the case of both-sided printing, the image surface of the side of the secondary transferring roller 10) of a passing sheet, the yellow toner may be generally unnoticeable or cannot be visually recognized for white sheets, and thus the back surface of the sheet can be prevented from being stained. For the stained sheet back surface in the secondary transferring roller 10, there is a low probability of the toner of the adjustment patterns residing below the stain prevention pattern consisting of yellow toner being attached to the sheet, and thus only the unnoticeable yellow toner may be attached. Consequently, higher quality of the sheet back surface can be maintained. Also, even if an edge area is stained during passage of the sheet through the secondary transferring unit, the stain can be suppressed to an extent that the yellow toner of the stain prevention pattern is slightly attached. Thus, the stain cannot be visually recognized, and higher quality of the sheet can be maintained.

Figure 3:
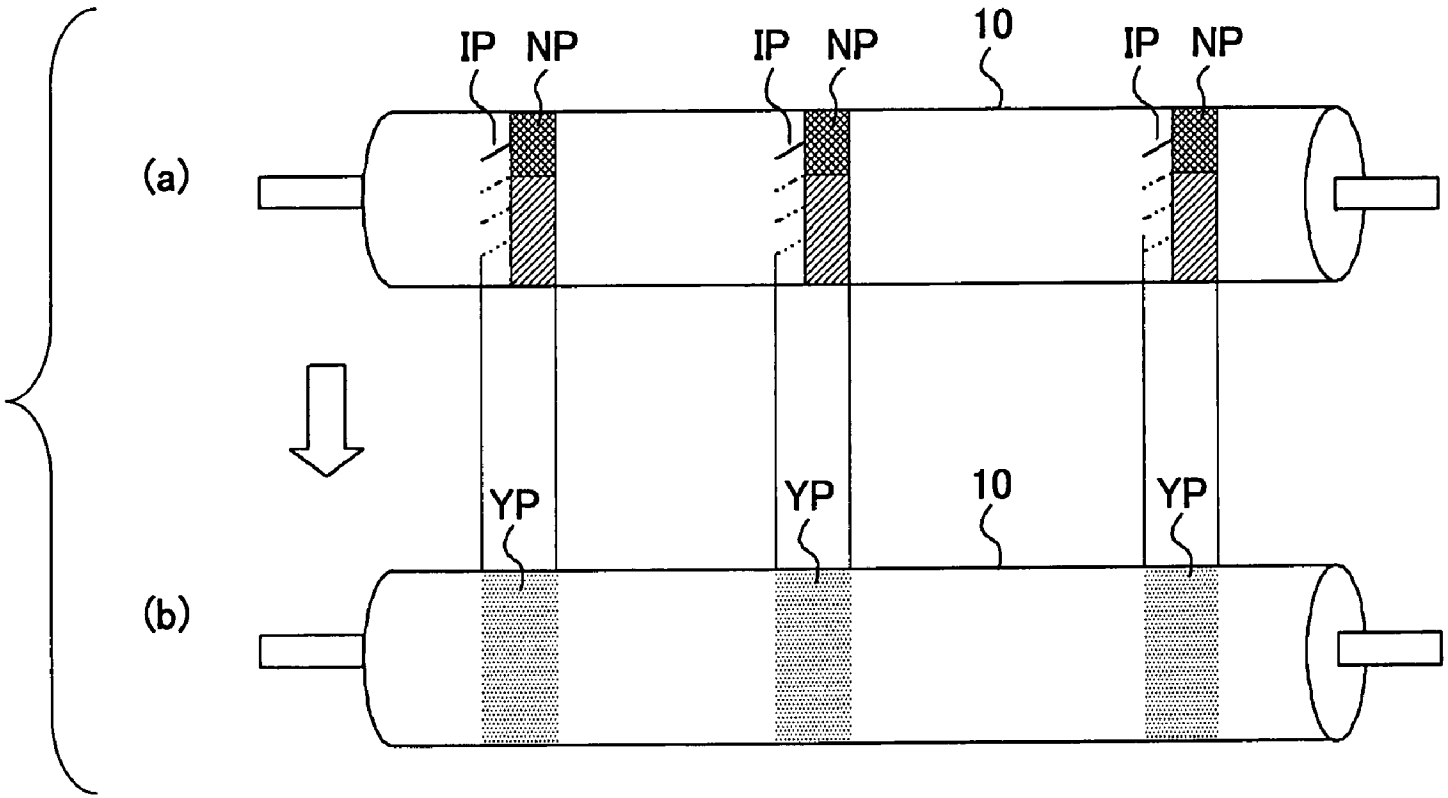
FIG. 3 is a schematic view of a concept of the present invention.

FIG. 3 is a schematic view of a concept of the present invention. As illustrated in FIG. 3A, toner of density adjustment patterns NPs and position adjustment patterns IPs is attached on the secondary transferring roller 10. As illustrated in FIG. 3B, stain prevention patterns YPs consisting of yellow toner are attached in such a manner that the toner of the attached adjustment patterns can be covered. The stain prevention pattern YP is provided to cover all the main scanning directional area and the sub-scanning directional area of the density adjustment patterns NPs and the position adjustment patterns IPs on the secondary transferring member. In this embodiment, the stain prevention pattern YP is provided to have one or more rounds (rotations) of the secondary transferring roller 10 in the sub-scanning direction. As a result, the stain prevention pattern YP consisting of yellow toner is provided on the uppermost surface of the secondary transferring roller 10, and thus even if the yellow toner is attached to the sheet back surface, the yellow toner may be unnoticeable, resulting in higher quality of the sheet back surface being maintained.

Figure 4:
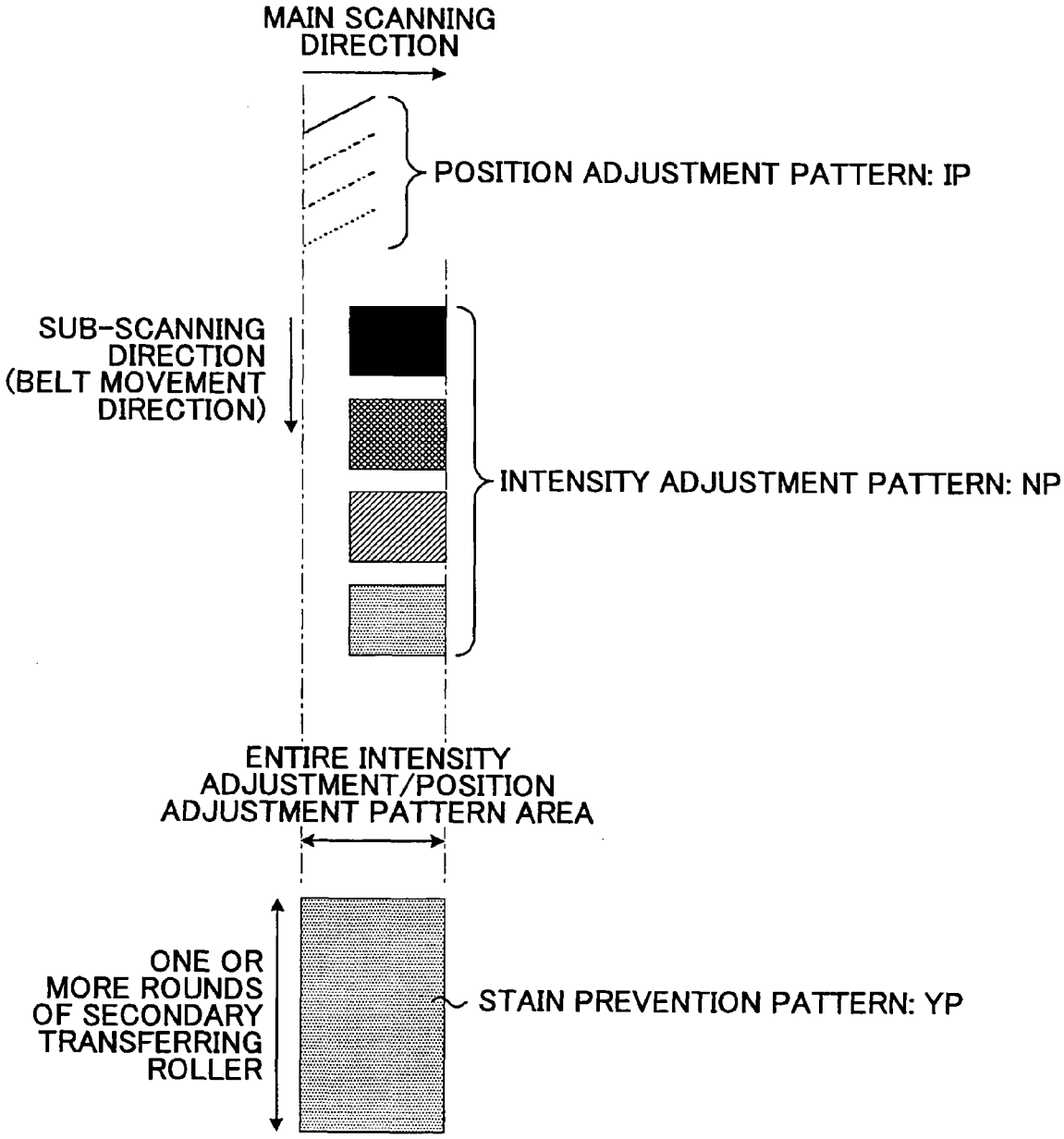
FIG. 4 is a schematic view of an exemplary case where a formed density adjustment pattern and a formed position adjustment pattern are misaligned with respect to a main scanning direction.

In general, the density adjustment pattern is configured as an area patch whereas the position adjustment pattern is configured as a linear patch. Similarly, these patches are used in the image forming apparatus according to this embodiment as illustrated in FIG. 3. Also, as illustrated in FIGS. 3 and 4, the density adjustment pattern and the position adjustment pattern are formed in such a manner that they are misaligned with each other with respect to the main scanning direction, that is, the width direction of the intermediate transferring belt 13 or the axial direction of the secondary transferring roller 10. The reason relates to the position where a sensor disposed opposite to the intermediate transferring belt 13 is installed. In this case, thus, the stain prevention pattern YP is made of yellow toner and attached to the secondary transferring roller 10 to cover the overall main scanning directional areas of the density adjustment pattern NP and the position adjustment pattern IP as illustrated in FIGS. 3 and 4.

Figure 5:
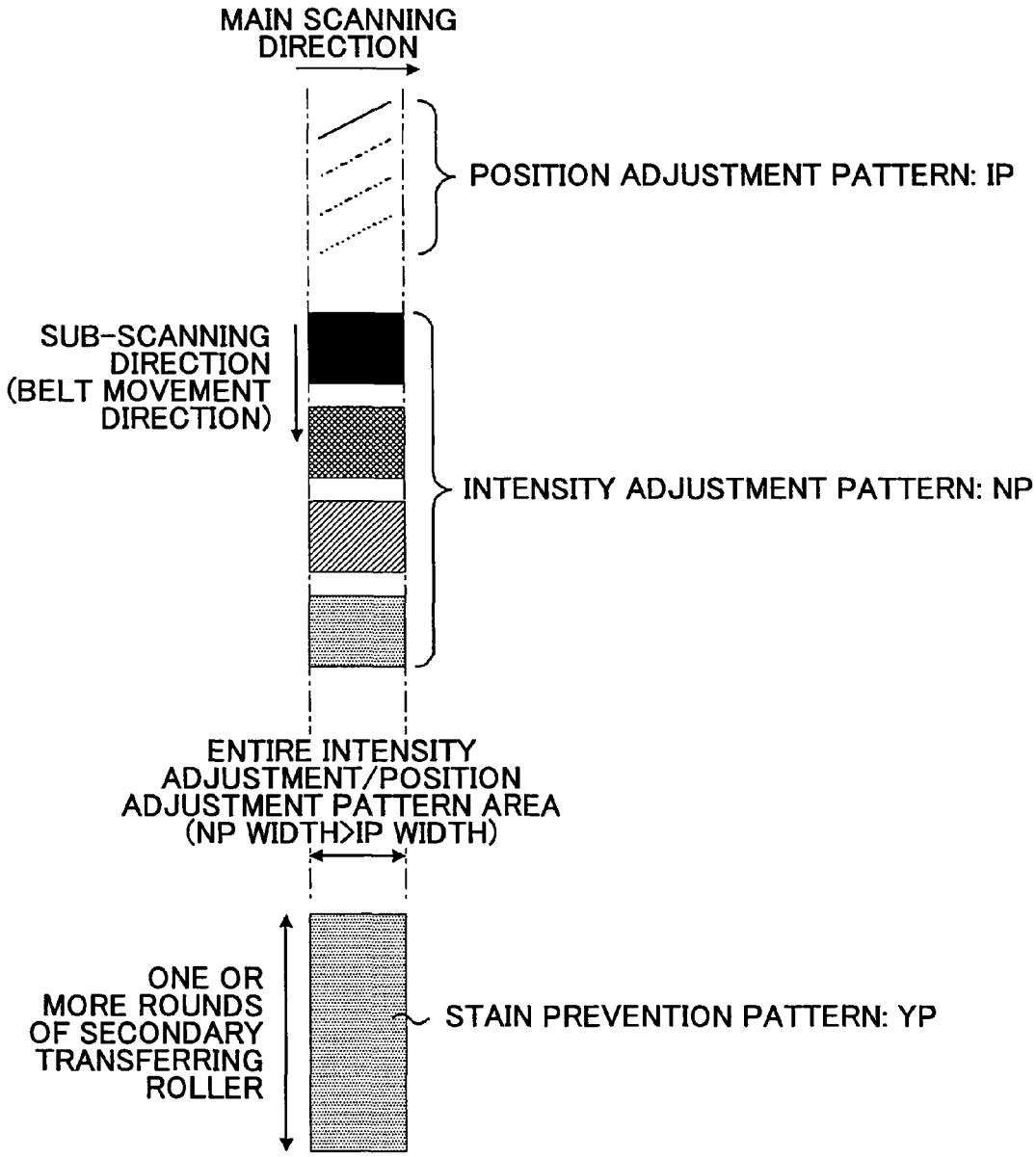
FIG. 5 is a schematic view of an exemplary case where the position adjustment pattern is accommodated within a printing area of the density adjustment pattern with respect to the main scanning direction.

Also, as illustrated in FIG. 5, a linear patch for the position adjustment pattern IP may be included within a main scanning directional printing area of an area patch for the density adjustment pattern NP. In this case, the width of the stain prevention pattern YP, that is, the main scanning directional length of the stain prevention pattern YP, can be made smaller, and a lesser amount of toner has to be consumed.

In this embodiment, the density adjustment pattern NP is formed for each color. Then, it is preferred that the yellow density adjustment pattern NP be finally provided. In this case, even if other color toner is attached to the secondary transferring roller 10, the yellow toner is further attached to the secondary transferring roller 10, resulting in the other color toner being hardly attached to the sheet back surface.

Also, it is preferred that the printing density of the stain prevention pattern YP be made approximately equal to the printing density of the area patch for the density adjustment pattern NP. In other words, if the density of the stain prevention pattern YP is less than the density of the density adjustment pattern NP, the stain prevention pattern YP cannot cover the density adjustment pattern NP and the position adjustment pattern IP attached to the tip of the secondary transferring roller 10. As a result, lower layer toner (toner of the density adjustment pattern NP or the position adjustment pattern IP) is transferred onto a sheet in passage of the sheet, resulting in the back surface of the sheet being stained. On the other hand, if the density of the stain prevention pattern YP is greater than the density of the density adjustment pattern NP, an excessive amount of yellow toner is attached to the secondary transferring roller 10, and thus the attached yellow toner may be recognized on the sheet back surface. In addition, consumption of a larger amount of toner may raise the cost. Thus, it is best that the density of the stain prevention pattern YP be made equal to the density of the density adjustment pattern NP.

Note that the density adjustment and the sub-scanning directional misalignment adjustment of the respective colors do not have to be made in a fixed sequence. Consequently, if the density adjustment and the position adjustment are made separately, the stain prevention pattern YP may be formed after execution of each of the adjustments and then attached to the secondary transferring roller 10. Alternatively, if the density adjustment and the position adjustment are made integrally, the stain prevention pattern YP is formed after execution of both the adjustments and then attached to the secondary transferring roller 10.

Also, in this embodiment, when the density adjustment and/or the position adjustment is made with use of the above-mentioned adjustment patterns, the bias with the same polarity as toner is applied to the secondary transferring roller 10. As a result, a lesser amount of toner can be attached to the secondary transferring roller 10, which is advantageous to the prevention of the sheet back surface being stained.

Furthermore, in these adjustments, the bias with the same polarity as the applied toner is preferably controlled depending on environmental variations. For example, a temperature sensor and/or a humidity sensor may be provided for detection of the temperature and/or the humidity, respectively, within the apparatus. Depending on the sensor's outputs, the bias applied to the secondary transferring roller 10 in the adjustment may be controlled. As a result, even if electric characteristics (resistance) of the intermediate transferring belt 13, the secondary transferring roller 10 or the toner is varied, the optimal bias can be applied. As a result, a lesser amount of toner can be attached on the secondary transferring roller 10, which is advantageous for prevention of the back surface of sheet being stained.

Specifically, different levels of the bias are applied in the adjustment to the secondary transferring roller 10. In conditions of low temperature and low humidity, −600 V of the constant bias is applied. In conditions of normal temperature and normal humidity, −500 V of the constant bias is applied. In conditions of high temperature and high humidity, −300 V of the constant bias is applied. As a result, stable cleaning performance of the secondary transferring roller is achieved. The set of values is simply one example and may be modified suitably for the system depending on the intermediate transferring belt, the secondary transferring roller, the resistance value of toner, the transferring nip width and other factors. Also, the bias control scheme is not limited to the above-mentioned low voltage control, and other schemes such as constant current control may be used.

Next, a color image forming apparatus according to a second embodiment of the present invention will be described below. This color image forming apparatus has the same configuration as the first embodiment. Thus, the same components are not described in detail here and different portions are focused on.

In the second embodiment, the stain prevention pattern consisting of yellow toner is not formed separately from the adjustment patterns, unlike the first embodiment, and an adjustment pattern for adjustment of image density is used to prevent sheets from being stained.

Figure 6:
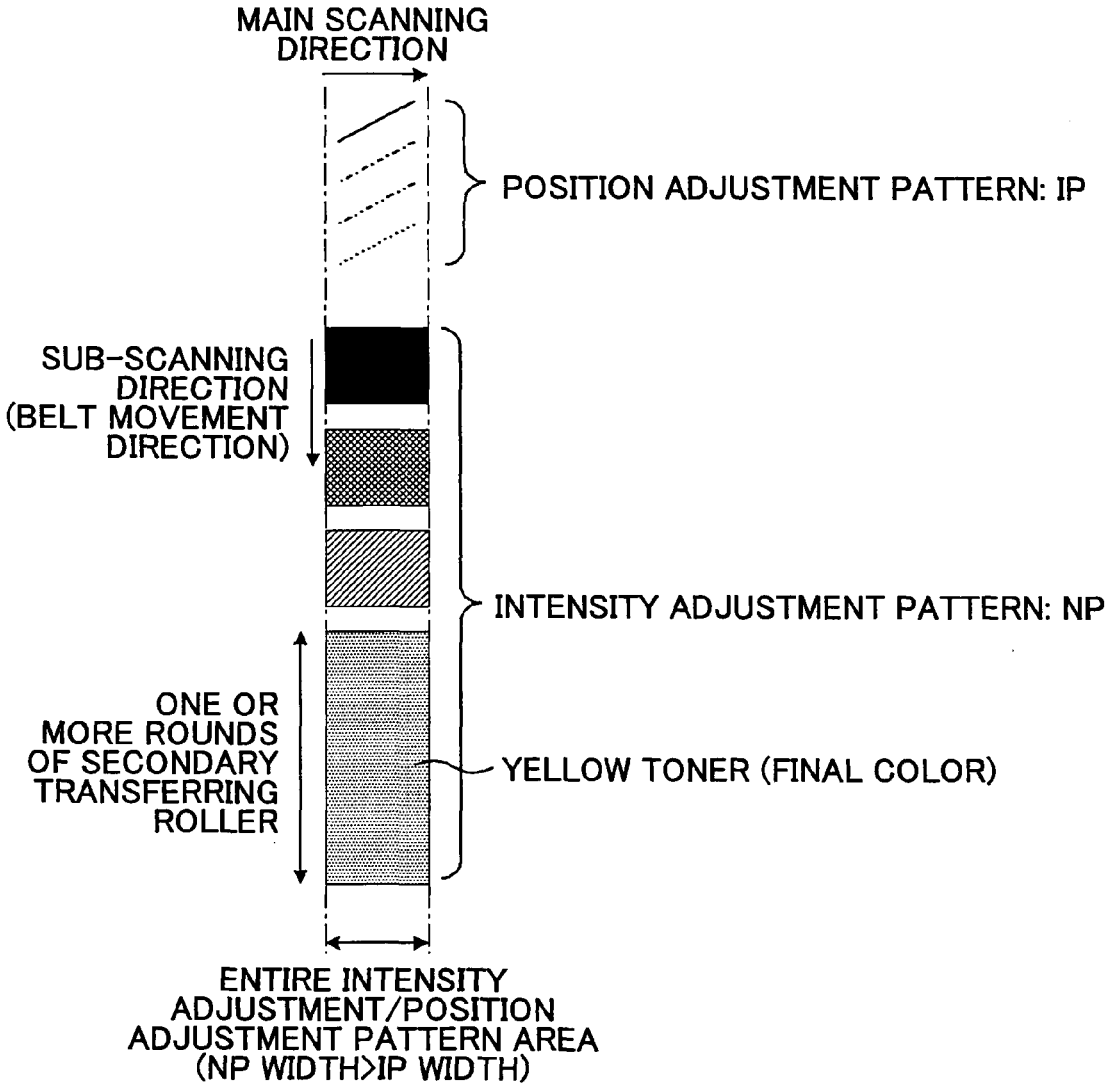
FIG. 6 is a schematic view of a second embodiment of the present invention.
Figure 7:
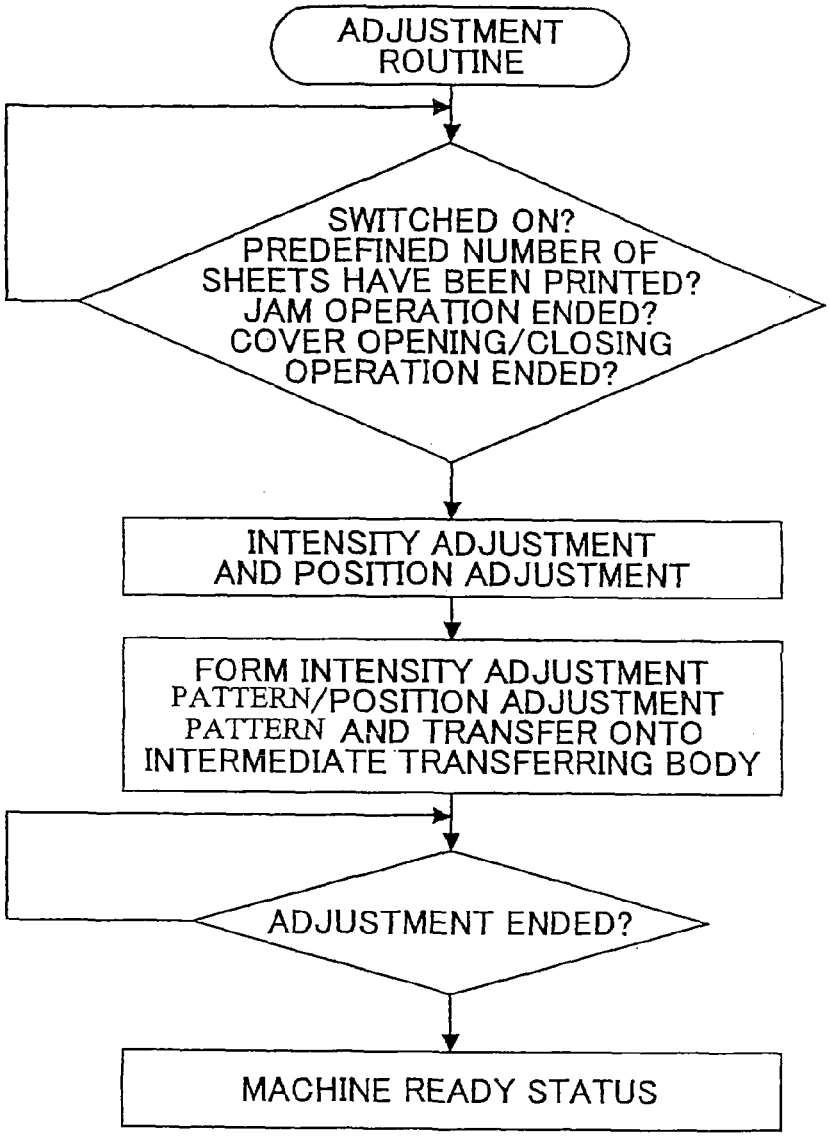
FIG. 7 is a flowchart of exemplary operations of image density adjustment and image misalignment adjustment in a generic image forming apparatus.

As illustrated in FIG. 6, in the second embodiment, a linear patch IP is used as a position adjustment pattern whereas an area patch NP is used as a density adjustment pattern. Then, the position adjustment pattern IP is included within a main scanning directional printing area of the density adjustment pattern NP. Also, the density adjustment patterns NPs are formed, and then a yellow pattern is used as the final pattern NP of them. The yellow pattern is provided to cover all a main scanning directional area and a sub-scanning directional area of the density adjustment patterns NPs and the position adjustment patterns IPs of other respective colors (other than yellow) on the secondary transferring member. In this embodiment, the sub-scanning directional size of the yellow pattern, that is, the final color pattern, is set to have one or more rounds of the secondary transferring roller 10. In the second embodiment, the density adjustment and the position adjustment are made integrally. The position adjustment is first carried out, and after that, the density adjustment is carried out. In this case, the final color toner, that is, the yellow toner, of the density adjustment pattern NP is provided on the uppermost surface of the secondary transferring roller 10, and thus even if the yellow toner is attached on the sheet back surface, the yellow toner is unnoticeable, resulting in high quality of the sheet back surface being maintained.

Also in the second embodiment, the density adjustment and the sub-scanning directional misalignment adjustment of the respective colors are not limited to a fixed sequence. Upon detection of a predefined event such as power switching of the apparatus, opening and closing of an external cover or termination of jam operations, the density adjustment and the sub-scanning directional misalignment adjustment of the respective colors are made. The adjustment is similar to some conventional ones.

Also, when the adjustment is carried out, the bias with the same polarity as toner is applied to the secondary transferring roller 10. As a result, a lesser amount of toner may be attached to the secondary transferring roller 10, which is advantageous to prevent the sheet back surface from being stained.

Similar to the first embodiment, it is preferred that the bias with the same polarity as the toner as applied in the adjustment be controlled depending on variations of the environment. The control is not limited to the low voltage control, and other schemes such as constant current control may be adopted similar to the first embodiment.

The specific embodiments of the present invention have been described, but the present invention is not limited to the embodiments. In the illustrated embodiments, multiple image carriers (photoconductors) are provided along the intermediate transferring body (intermediate transferring belt). In other embodiments of the present invention, however, multiple developing units are provided around a single image carrier, and respective color images are sequentially superposed and transferred onto the intermediate transferring body. Alternatively, a revolver type of developing unit (rotary developing unit) may be used.

In other embodiments of the present invention, the size and/or the shape of the density adjustment pattern and the position adjustment pattern are not limited. Also, the secondary transferring member is not limited to the transferring roller and may be configured from a transferring belt.

In addition, the present invention is applicable to a full-color machine using three colors of toner. The inventive image forming apparatus is not limited to a printer and may be configured from a copier, a facsimile machine or a multifunction peripheral (MFP) including multiple functions.

The present invention is not limited to the specifically disclosed embodiments, and variations and modifications may be made without departing from the scope of the present invention.

The present application is based on Japanese Priority Patent Application No. 2007-061818 filed Mar. 12, 2007, the entire contents of which are hereby incorporated herein by reference.

What is claimed is:

1. An image forming apparatus including an image carrier, an intermediate transferring body and a contact type secondary transferring member transferring an image from the intermediate transferring body to a recording medium but including no contact and release mechanism contacting and/or releasing the secondary transferring member with/from the intermediate transferring body, the image forming apparatus forming an image with respective developers for multiple colors and using a predefined adjustment pattern to make density adjustment and position adjustment of respective color images, after execution of the density adjustment and/or the position adjustment, a stain prevention pattern being formed with a yellow developer to cover an area where the adjustment pattern is attached to the secondary transferring member, the formed stain prevention pattern being carried on the intermediate transferring body.

2. The image forming apparatus as claimed in claim 1, a main scanning directional size of an adjustment pattern for the position adjustment being smaller than a main scanning directional size of an adjustment pattern for the density adjustment, and a main scanning directional position of an adjustment pattern for the position adjustment being within a main scanning directional width of an adjustment pattern for the density adjustment.

3. The image forming apparatus as claimed in claim 1, a density of the stain prevention pattern being made equal to a density of an adjustment pattern for the density adjustment.

4. The image forming apparatus as claimed in claim 1, in the density adjustment and/or the position adjustment, a bias with the same polarity as an electrifying polarity of the developer being applied to the secondary transferring member.

5. The image forming apparatus as claimed in claim 4, the bias being controlled depending on environmental conditions.

6. The image forming apparatus as claimed in claim 1, the adjustment pattern for the density adjustment being configured as an area pattern.

7. The image forming apparatus as claimed in claim 1, the adjustment pattern for the position adjustment being configured as a linear pattern.

8. The image forming apparatus as claimed in claim 1, the secondary transferring member comprising a transferring roller, and a sub-scanning directional size of the stain prevention pattern or a size of a yellow adjustment pattern of the density adjustment being larger than a circumferential length of the transferring roller.

9. An image forming apparatus including an image carrier, an intermediate body and a contact type secondary transferring member transferring an image from the intermediate transferring body to a recording medium but including no contact and release mechanism contacting and/or releasing the secondary transferring member with/from the intermediate transferring body, the image forming apparatus forming an image with respective developers for multiple colors and using a predefined adjustment pattern to make density adjustment and position adjustment of respective color images, a main scanning directional size of an adjustment pattern for the position adjustment being smaller than a main scanning directional size of an adjustment pattern for the density adjustment, a main scanning directional position of an adjustment pattern for the position adjustment being within a main scanning directional width of an adjustment pattern for the density adjustment, in the density adjustment and the position adjustment, the position adjustment being first made and subsequently the density adjustment being made, and a final color adjustment pattern of respective color adjustment patterns for the density adjustment being a yellow adjustment pattern, the yellow adjustment pattern being provided to cover an area where the color adjustment patterns other than the yellow adjustment pattern are attached to the secondary transferring member.

10. A method of forming an image, an image transferred from an image carrier to an intermediate transferring body being transferred by a contact type secondary transferring member from the intermediate transferring body to a recording medium, and after a predefined pattern is used to make an image density adjustment and/or an image position adjustment for multiple colors, a stain prevention pattern being formed of a yellow developer to cover an area where the adjustment pattern is attached to the secondary transferring member.

* * * * *

UNITED STATES PATENT AND TRADEMARK OFFICE

CERTIFICATE OF CORRECTION

PATENT NO. : 7,817,928 B2
APPLICATION NO. : 12/071338
DATED : October 19, 2010
INVENTOR(S) : Tsuchida et al.

It is certified that error appears in the above-identified patent and that said Letters Patent is hereby corrected as shown below:

Page 1, number 73, Assignee reads: Ricoh Company, Limited

Page 1, number 73, Assignee should read: Ricoh Company, Ltd.

Signed and Sealed this
Third Day of January, 2012

David J. Kappos

David J. Kappos
*Director of the United States Patent and Trademark Office*